US006860421B2

(12) United States Patent
Lo Duca

(10) Patent No.: US 6,860,421 B2
(45) Date of Patent: Mar. 1, 2005

(54) BOX WITH CLOSURE PANEL AND SECURITY SEAL AND WITH ELEMENTS FOR MAINTAINING THE PANEL CLOSED AFTER BREAKAGE OF THE SEAL

(75) Inventor: Carmelo Lo Duca, Milan (IT)

(73) Assignee: GI.BI.EFFE SRL, Milan (IT)

( * ) Notice: Subject to any disclaimer, the term of this patent is extended or adjusted under 35 U.S.C. 154(b) by 94 days.

(21) Appl. No.: 10/372,274

(22) Filed: Feb. 25, 2003

(65) Prior Publication Data

US 2004/0108369 A1 Jun. 10, 2004

(30) Foreign Application Priority Data

Feb. 25, 2002 (IT) ..... MI2002A0369

(51) Int. Cl.[7] ..... B65D 5/10
(52) U.S. Cl. ..... 229/102; 229/150; 229/153
(58) Field of Search ..... 229/102, 148, 229/150, 153, 222, 223; 206/807

(56) References Cited

U.S. PATENT DOCUMENTS 1,989,659 A * 2/1935 Adsit et al. ..... 229/153
2,116,652 A * 5/1938 Adler ..... 229/148
3,578,154 A * 5/1971 Martelli ..... 229/153
4,163,492 A * 8/1979 Rella ..... 229/150
4,752,028 A * 6/1988 Ogura ..... 229/102
4,890,789 A * 1/1990 Lo Duca ..... 229/102
4,917,288 A * 4/1990 Heitele et al. ..... 229/102
5,207,374 A * 5/1993 Lo Duca ..... 229/102
6,296,176 B1 * 10/2001 Frenois et al. ..... 229/153

FOREIGN PATENT DOCUMENTS

DE 3826231 A1 * 2/1990 ..... 229/148
EP 0 709 293 5/1996
GB 1 133 776 11/1968

* cited by examiner

*Primary Examiner*—Gary E. Elkins
(74) *Attorney, Agent, or Firm*—Oblon, Spivak, McClelland, Maier & Neustadt, P.C.

(57) ABSTRACT

A box formed from a single piece of punched and crease-lined cardboard sheet including at least four consecutive main panels, a flap, two closure panels, at least one tab, and a lip.

3 Claims, 2 Drawing Sheets

BOX WITH CLOSURE PANEL AND SECURITY SEAL AND WITH ELEMENTS FOR MAINTAINING THE PANEL CLOSED AFTER BREAKAGE OF THE SEAL

DESCRIPTION

The present invention relates to a box formed from a single piece of punched and crease-lined cardboard or the like, of the type having at least one closure panel of high resistance to opening in which there is provided at least one window into which there hookingly penetrates a profiled tooth projecting from at least one flap which lies below and in contact with the panel when this is closed in order to increase its resistance to opening, these teeth causing a portion of the panel to break when opened for the first time, hence acting as a security seal.

U.S. Pat. No. 4,890,789 and the corresponding EP-B-0318750, U.S. Pat. No. 5,207,374 and the corresponding EP-B-0519389, and DE-A-3826231 describe boxes having at least one closure panel of high resistance to opening: this panel has a flap which can be folded and inserted into the box to the side of a lateral edge of one or more tabs projecting from respective main panels of the box and folded into the box interior below the main panel (such a structure is traditional for all boxes of this type). In the panel flap there is provided at least one cut which, when the flap is folded about the panel, forms a window in the flap and a corresponding appendix which projects from the panel, with which this appendix remains coplanar.

When the box is closed, and the panel flap is inserted into the box, into the windows formed therein there penetrate hook or dovetail shaped teeth which project from the side edges of the tabs situated below the closed panel. These teeth project beyond the outer surface of the flap and are positioned below the respective appendices projecting from the panel. When the panel is pulled to open it, it drags and raises the profiled teeth projecting from the tabs so that they securely hook onto the flap of the panel, to considerably increase its resistance to opening. The structure and characteristics of boxes of this type are well known and are described in the aforestated patents, hence no further comment is necessary.

EP-B-0709293 describes a box similar to the aforedescribed, but differs therefrom in that between the closure panel and the flap projecting from it there is a preferential tearing line (usually a succession of small cuts or knurlings) which cause a portion of the flap to tear or the entire flap to separate from the panel, when the box is opened the first time. The profiled teeth which project from the box tabs and which hook into the windows provided in the flap retain the flap with a force greater than that required to cause partial or total separation of the flap when the panel is raised to open the box. The problem which arises is that, after the box has been opened, according to the teachings of EP-B-0709293, the panel can no longer be closed and retained in its closed position (if the entire flap projecting from it has been torn away), or can be retained only at its end (if only a portion of the flap has been torn off on first opening the box). The main object of the present invention is therefore to improve the boxes of known type described in EP-B-0709293 by making it possible to effectively and repeatedly close the box after the box has been opened the first time and the flap projecting from its closure panel and acting as the security seal has been totally or partly torn off.

Another object is to provide a box of low cost, and of simple production, assembly and use.

These and further objects are attained by a box formed from a single piece of punched and crease-lined cardboard or the like, comprising

- at least four consecutive main panels and a flap projecting from the first main panel and superposed on and glued onto the last main panel, the main panels and said flap being separated from each other by parallel folding lines,
- two closure panels for the two ends of the box and projecting from the ends of at least one of the main panels,
- at least one tab projecting from the ends of at least one of the main panels consecutive to that from which the closure panels project, the closure panels and said tab being separated from the main panels by transverse folding lines perpendicular to said longitudinal folding lines,
- a lip projecting from each closure panel and separated from each respective closure panel by a folding line parallel to said transverse folding lines, each lip being inserted into the closed box below a main panel different from those from which the closure panels and said flap project, in the cardboard sheet there being provided cuts which define at least one appendix projecting from at least one closure panel, to leave a corresponding window free within each lip when each lip is folded about the respective closure panel from which each lip projects, there also being provided a knurling which extends along the length of the folding line between each lip and each respective closure panel to define a tearing line along which each lip can be torn away from the respective closure panel,
- from said tab there laterally projecting a hook-shaped tooth which, in the closed box, projects through the window formed in a first lip to retain the first lip and the respective closure panel in its closed position, characterised in that from that main panel on the inside of which the first lip projecting from the respective closure panel is positioned, there projects a supplementary tab in which an aperture is provided, said supplementary tab being separated from the main panel from which the supplementary tab projects by a transverse folding line from which said aperture is spaced and being folded into an interior of the box onto an inner surface of the main panel from which said supplementary tab it projects, a free end of said appendix being positionable through and retained in said aperture when the box is reclosed after being opened for the first time with consequent separation of the lip from the closure panel.

Preferably, the length of the closure panel in correspondence with the appendix projecting from it is at least equal to the distance between the opposing transverse folding lines which separate the closure panel and respectively the supplementary tab from the respective main panels, said supplementary tab being glued to the surface of the main panel onto which it is folded.

The invention also relates to the punched and crease-lined one-piece sheets of cardboard or similar flexible material for forming a box such as the aforesaid.

The structure and characteristics of the box will be more apparent from the ensuing description of two embodiments thereof given by way of non-limiting example with reference to the accompanying drawings, in which:

FIGS. from 1 to 4 represent a punched and crease-lined cardboard sheet shown laid flat and in its successive stages of folding to form a box;

Figure 1:
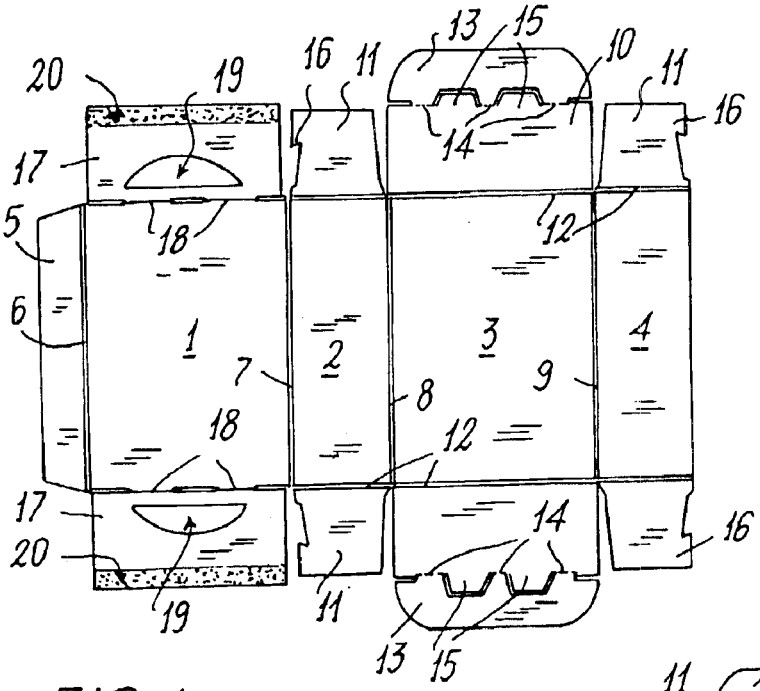

Reference will be firstly made to FIGS. from 1 to 4 which show a punched and crease-lined cardboard sheet comprising four consecutive main panels 1–4 and a flap 5 projecting from the panel 1, they being separated from each other by parallel longitudinal folding lines 6–9. Two closure panels 10 project from the two opposing ends of the panel 3, whereas tabs 11 project from the ends of the panels 2 and 4. The closure panels 10 and the tabs 11 are separated from the respective main panels by transverse folding lines 12 perpendicular to the longitudinal folding lines 6–9.

From each closure panel 10 there projects a lip 13 which is separated from the panel itself by a folding line parallel to the lines 12 and consisting of a succession of knurlings or of successions of small cuts 14 interrupted by continuous cuts which define two projecting appendices 15 within each tab 13. When the knurlings 14 are torn through, the lips 13 separate from the closure panels 10, from the free ends of which the appendices 15 project.

From one side of the tabs 11 there project hook-shaped teeth 16 which are inserted into the closed box (as explained hereinafter) to hook into the windows left free in the lips 13 by the appendices 15, when the box is closed.

Again, as can be seen from FIG. 1, from the two opposing ends of the main panel 1 there project two supplementary tabs 17 which are separated from the panel by supplementary folding lines 18 perpendicular to the folding lines 6–9. In each supplementary tab 17 there is provided an aperture 19 of substantially half moon shape, its rectilinear edge being slightly spaced from the folding line 18.

It will now be assumed that the flat cardboard sheet of FIG. 1 is to be used to form a box.

Figure 2:
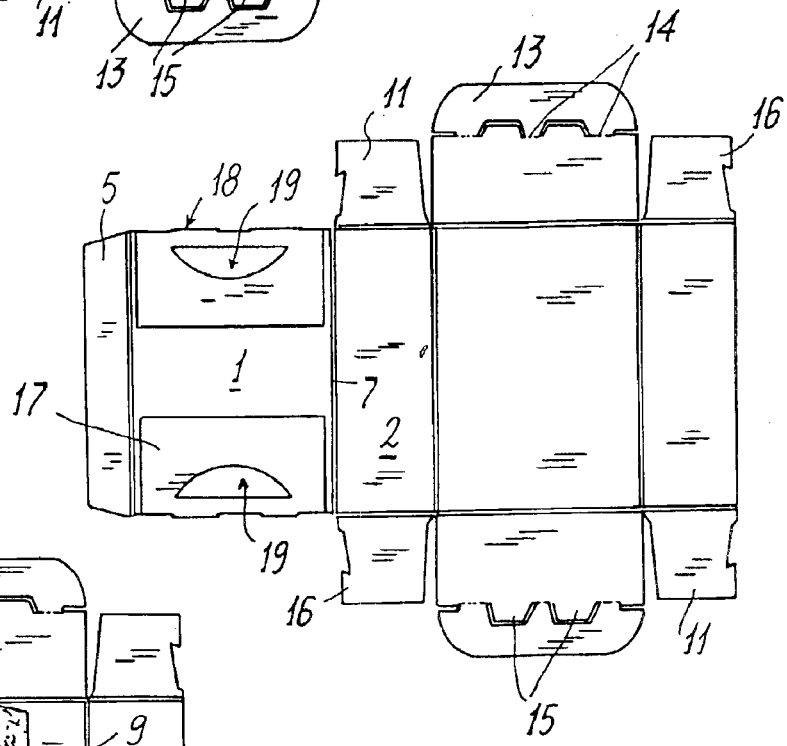
Figure 3:
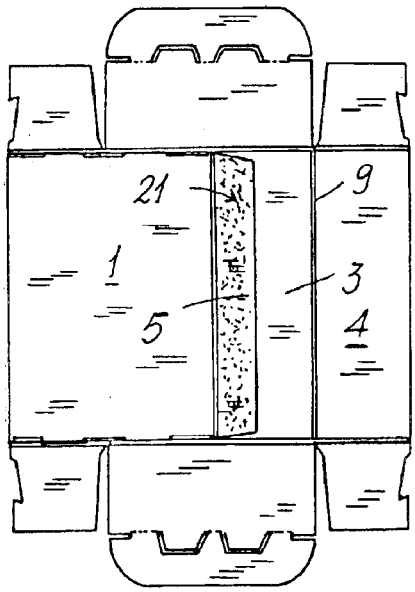
Figure 4:
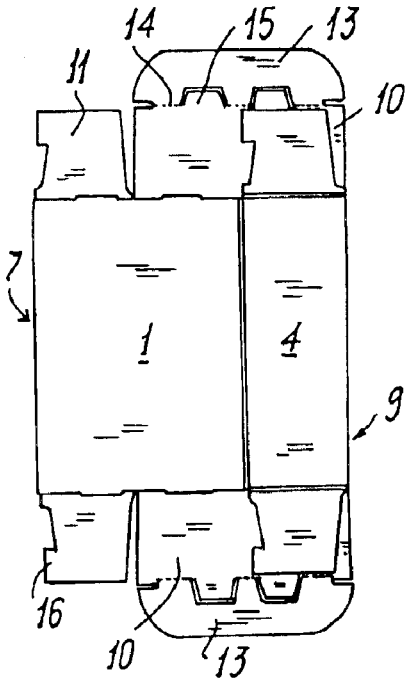

After applying glue 20 to the free edges of the supplementary tabs 17, these tabs are folded onto the panel 1, so that they adhere to them (FIG. 2). The cardboard sheet is then folded about the folding line 7, applying glue 21 to the outer surface of the flap 5 (FIG. 3), after which the panel 4 is folded about the folding line 9, superposing its free edge onto the flap 5 and making it adhere to it (FIG. 4).

At this point the box preparation by the box manufacturer is complete and the box is ready to be used by the firm which is to insert and keep the articles to be contained in the box.

Figure 5:
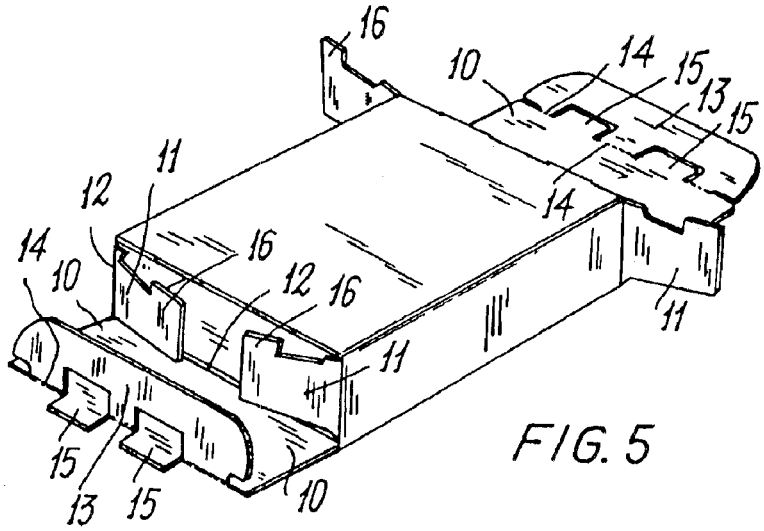
FIG. 5 is a perspective view of a finished box, with the two closure panels open.

Using well known high speed machines, pressure is inserted between the folding lines 7 and 9 and the tabs 11 and lips 13 are folded to open the box out from its flattened state of FIG. 4 to the intermediate state of FIG. 5, from which the two panels 10 can be moved into their closed position (after inserting into the box the articles to be contained therein) in which the lips 13 are inserted and slid inside the box below the main panel 1. Under these conditions, the hook-shaped teeth 16 penetrate into the windows of the lips 13, left free by the appendices 15 which remain coplanar with the respective closure panels 10.

Figure 6:
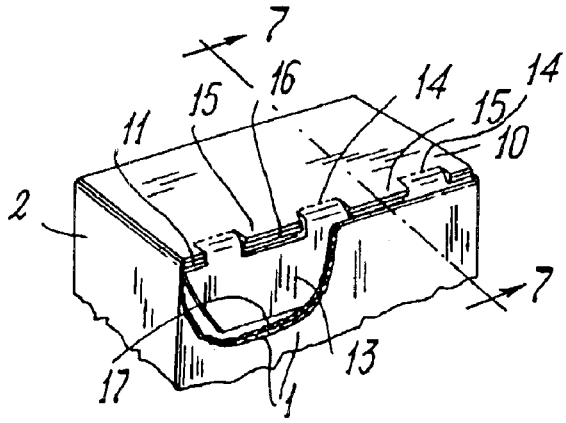
FIG. 6 is a perspective view on an enlarged scale showing one end of a closed box, some portions of the box having been removed for clarity.

The hook-shaped teeth 16 securely hook onto the sides of the windows in the lips, contributing to the resistance of the panels 10 to opening, as can be seen from FIG. 6 on an enlarged scale. After closure of the box, when it is opened for the first time the teeth 16 retain the lips 13, causing them to tear and separate along the knurled tearing lines 14, the lips hence also acting as a security seal (possibly visible from the outside through a hole provided in the wall 1).

All the aforedescribed characteristics (excluding the presence of the supplementary tabs 17 with relative apertures 19) is well known and described and illustrated on the prior patents cited in the introduction to this description.

Figure 7:
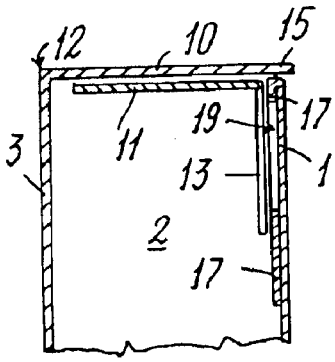
FIGS. 7 and 8 show schematically an end portion of a closed box, before and respectively after the tearing of the flap acting as the security seal.

From the figures, and in particular FIGS. 6 and 7, it can be seen that the width of each closure panel 10 in correspondence with the appendix 15 projecting from it is greater than the distance between the opposing transverse folding lines 12, 18 which separate the closure panel and the supplementary tab from the respective main panels, such that when the box is closed and the lip 13 is still joined to the closure panel, the appendices 15 rest on the free edge of the main panel, in correspondence with the folding line 18.

Figure 8:
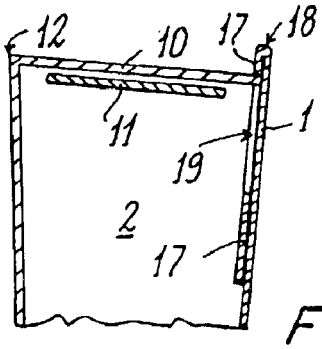

When the box is opened for the first time, the teeth 16 cause the lip 13 to separate, but the closure panel 10 can still be repeatedly and easily returned to its closed position by slightly rotating this panel inside the box, while the appendices 15 bend the main panel 1 slightly outwards, until these appendices become positioned within the apertures 19, as shown schematically in an accentuated manner in FIG. 8. Under these conditions the panel 10 is securely retained by the free edges of the apertures 19, especially by virtue of the fact that the bending resistance of the box walls is strongly increased by the presence (in its interior) of the supplementary tab 17 and also the fact that this tab is glued onto the main wall on which it is superposed.

It is apparent that the width of each closure panel 10 in correspondence with the appendix 15 can be equal to the distance between the folding line 12 of the panel 10 and the opposing inner surface of the panel 1. In that case, when the panel 10 is reclosed after being opened for the first time with consequent tearing and removal of the tab 13, the appendices 15 become positioned within the apertures 19 of the supplementary tabs 17, without causing the main panel 1 to flex outwards. The retention of the appendix 15 (and of the closure panel) would in any event be effective because in correspondence with the apertures 19, the thickness of the panel 1 is doubled by the presence of the bent supplementary tab 17 in its interior, so greatly increasing the resistance to bending in an outward direction (which would cause the appendix 15 to disengage from the respective aperture 19).

Figure 9:
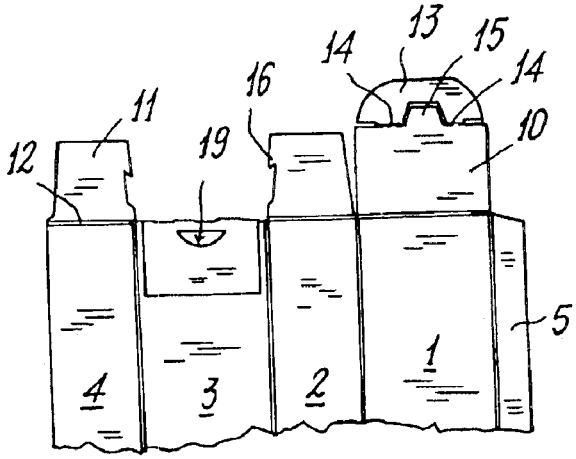
FIG. 9 is similar to FIG. 2 and shows one portion of a box different from that of the preceding figures.

It is also apparent that the boxes can be different from those shown in FIGS. from 1 to 8. For example, the described closure panel and supplementary tab can be provided at only one end of the box; a single appendix can be provided (instead of two as described up to now), so that the box can be such as is obtainable from the cardboard sheet of which a portion is shown in FIG. 9 (and which uses for simplicity the same reference numerals already used in FIGS. 1–8), and of which a detailed description is unnecessary.

What is claimed is:

1. A box formed from a single piece of punched and crease-lined cardboard sheet comprising at least four consecutive main panels and a flap projecting from the first main panel and superposed on and glued onto the last main panel, the main panels and said flap being separated from each other by parallel folding lines, two closure panels for two ends of the box and projecting from ends of at least one of the main panels, at least one tab projecting from one end of at least one of the main panels consecutive to that from which the closure panels project, the closure panels and said tab being, separated from the main panels by transverse folding lines perpendicular to said longitudinal folding lines, a lip projecting from each closure panel and separated from each respective closure panel by a folding line parallel to said transverse folding lines, each lip being inserted into the closed box below a main panel different from those from which the closure panels and said flap project, in the cardboard sheet there being provided cuts which define at least one appendix projecting from at least one closure panel, to leave a corresponding window free within each lip when each lip is folded about the respective closure panel from which each lip projects, there also being provided a knurling which extends along the length of the folding line between each lip and each respective closure panel to define a tearing line along which each lip can be torn away from the respective closure panel, from said tab there laterally projecting a hook-shaped tooth which, in the closed box, projects through the window formed in a first lip to retain the first lip and the respective closure panel in its closed position, wherein from that main panel on the inside of which the first lip projecting from the respective closure panel is positioned, there projects a supplementary tab in which an aperture is provided, said supplementary tab being separated from the main panel from which the supplementary tab projects by a transverse folding line from which said aperture is spaced and being folded into an interior of the box onto an inner surface of the main panel from which said supplementary tab projects, a free end of said appendix being positionable through and retained in said aperture when the box is reclosed after being opened for the first time with consequent separation of the first lip from the respective closure panel.

2. A box as claimed in claim 1, wherein a width of each closure panel and the appendix projecting therefrom is at least equal to the distance between the opposing transverse folding line which separate each closure panel and respectively the supplementary tab from the respective main panels.

3. A box as claimed in claim 2, wherein said supplementary tab is glued to the inner surface of the main panel onto which said supplementary tab is folded.

* * * * *